US012723359B2

(12) United States Patent
Bianchini

(10) Patent No.: US 12,723,359 B2
(45) Date of Patent: Sep. 1, 2026

(54) PROTECTION STRUCTURE AND METAL PROTECTION NET FOR SUCH A PROTECTION STRUCTURE

(71) Applicant: OFFICINE MACCAFERRI S.p.A., Zola Predosa (IT)

(72) Inventor: Paolo Bianchini, Zola Predosa (IT)

(73) Assignee: OFFICINE MACCAFERRI S.p.A., Zola Predosa (BO)

( * ) Notice: Subject to any disclaimer, the term of this patent is extended or adjusted under 35 U.S.C. 154(b) by 302 days.

(21) Appl. No.: 18/546,126

(22) PCT Filed: Feb. 14, 2022

(86) PCT No.: PCT/IB2022/051287
§ 371 (c)(1),
(2) Date: Aug. 11, 2023

(87) PCT Pub. No.: WO2022/172239
PCT Pub. Date: Aug. 18, 2022

(65) Prior Publication Data

US 2024/0133136 A1 Apr. 25, 2024
US 2024/0229382 A9 Jul. 11, 2024

(30) Foreign Application Priority Data

Feb. 12, 2021 (IT) ..... 102021000003179

(51) Int. Cl.
*E01F 7/04* (2006.01)

(52) U.S. Cl.
CPC ..... *E01F 7/04* (2013.01)

(58) Field of Classification Search
CPC ..... E01F 7/00; E01F 7/02; E01F 7/025; E01F 7/04; E01F 7/045; E04H 17/08; Y10S 256/01
USPC ..... 256/12.5, DIG. 1
See application file for complete search history.

(56) References Cited

U.S. PATENT DOCUMENTS 5,395,105 A * 3/1995 Thommen, Jr. ..... E01F 7/045 256/12.5
5,961,099 A * 10/1999 Thommen, Jr. ..... E01F 7/04 256/12.5
6,131,873 A * 10/2000 Blazon ..... E01F 7/045 248/548

(Continued)

FOREIGN PATENT DOCUMENTS

CH 693639 A5 * 11/2003 ..... E01F 7/04
CN 210086126 U * 2/2020 ..... E01F 15/02

(Continued)

OTHER PUBLICATIONS

The alloy with a memory, 55-Nitinol: Its physical metallurgy, properties, and applications. Jackson, et al. National Aeronautics and Space Administration, 1972.*

(Continued)

*Primary Examiner* — Josh Skroupa
(74) *Attorney, Agent, or Firm* — FLYNN THIEL, P.C.

(57) ABSTRACT

A protection structure for civil works including at least one metal protection net. The at least one metal protection net has a plurality of elongate resistant elements in the form of wire, rope or cable. At least some of the plurality of elongate resistant elements are made from a material having super-elastic behaviour.

5 Claims, 3 Drawing Sheets

(56) References Cited

U.S. PATENT DOCUMENTS

| | | | | |
|---|---|---|---|---|
| 7,188,825 | B2 * | 3/2007 | Sennhauser | E01F 7/045 256/12.5 |
| 7,455,155 | B2 * | 11/2008 | Castro Fresno | E01F 7/045 256/1 |
| 7,744,313 | B2 * | 6/2010 | Terai | E01F 13/12 405/211 |
| 11,015,309 | B2 * | 5/2021 | Song | E01F 7/04 |
| 11,255,060 | B2 * | 2/2022 | Lanter | E01F 7/04 |
| 12,379,013 | B2 * | 8/2025 | Sennhauser | E01F 7/045 |
| 2013/0251461 | A1 * | 9/2013 | Fulde | E01F 7/04 140/102 |

FOREIGN PATENT DOCUMENTS

| | | | | |
|---|---|---|---|---|
| DE | 102006013526 | A1 * | 8/2007 | E01F 7/045 |
| EP | 0940503 | A1 | 9/1999 | |
| FR | 2414586 | A1 * | 8/1979 | E01F 7/045 |
| FR | 2669047 | A1 * | 5/1992 | E01F 7/045 |
| FR | 2936786 | A1 * | 4/2010 | E01F 7/045 |
| FR | 2984375 | A1 | 6/2013 | |
| FR | 3032463 | B1 * | 10/2021 | E01F 7/045 |
| JP | 2002275835 | A * | 9/2002 | E01F 7/04 |
| JP | 201484626 | A | 5/2014 | |
| JP | 2014084626 | A * | 5/2014 | E01F 7/04 |
| JP | 2017179850 | A | 10/2017 | |
| JP | 2017193882 | A | 10/2017 | |
| KR | 1020140016554 | A | 2/2014 | |
| WO | 2005038143 | A1 | 4/2005 | |
| WO | 2011030316 | A1 | 3/2011 | |
| WO | WO-2013171592 | A1 * | 11/2013 | E01F 7/04 |
| WO | 2014141096 | A1 | 9/2014 | |
| WO | 2018146516 | A1 | 8/2018 | |
| WO | WO-2020079543 | A1 * | 4/2020 | E01F 7/04 |
| WO | 2021053592 | A1 | 3/2021 | |

OTHER PUBLICATIONS

International Search Report issued in corresponding International Application No. PCT/IB2022/051287 date of mailing May 13, 2022 (4 pages).

Written Opinion of International Searching Authority issued in corresponding International Application No. PCT/IB2022/051287 dated May 13, 2022 (6 pages).

G. Song et al., Applications of shape memory alloys in civil structures, Engineering Structures, ScienceDirect, Abstract, vol. 28, Issue 9, Jul. 2006, pp. 1266-1274 (5 pages).

Castanon-Jano et al., Energy Dissipating Devices in Falling Rock Protection Barriers, Rock Mech Rock Eng, vol. 50, No. 3, Nov. 2016, pp. 603-619 (17 pages).

Notice of Reasons for Refusal, with English translation, issued in corresponding Japanese Application No. 2023-547098 dated Sep. 2, 2025 (8 pages).

* cited by examiner

PROTECTION STRUCTURE AND METAL PROTECTION NET FOR SUCH A PROTECTION STRUCTURE

FIELD OF THE INVENTION

The present invention relates to the field of structures for protection from events of geological instability, such as rockfalls, snowslips or debris flows.

The invention has been developed with particular regard for protection structures which comprise at least one metal protection net.

Technological Background

In mountainous zones, it is known to provide structures for protection from events of geological instability or hydrogeological instability, in which there is an unexpected movement of materials, such as rocks, stones, debris or snow from an upstream zone towards a downstream zone as a result of natural and unpredictable causes, such as, for example, landslips, snowslips or waves of debris flows. These protection structures generally comprise at least one metal net which prevents or delays the movement of the material in a downstream direction.

Protection from rockfalls or debris flows is a key element for safety and the resilience of infrastructure, buildings, goods and persons. Even the smallest landslip or debris flows can produce serious damage and interruptions of use and consequently economic losses of great magnitude. The same can be said for the damaging and disadvantageous effects of snowslips and avalanches which can take place in snow-bound mountainous zones.

In recent years, the public administration bodies have paid increasing attention to the event of "rockfalls", characterized by the detachment and subsequent movement downstream of blocks of stone with dimensions between 0.02 $m^3$ and 5 $m^3$ at speeds which can reach and sometimes exceed 30 m/s, causing serious damage to the structures below. This event further represents a relevant problem of public safety for all the structures, constructions and connection routes which are located in the areas of interest of zones which are subjected to such events.

In the past, among the interventions involving passive protection against rockfalls, there were mainly distinguished rigid barriers which are constituted by metal panels, for example, not very flexible structures which, by intercepting and retaining the rocks, leave the function of dissipating the impact energy to the materials which constitute the structures with rigid elements made from steel.

Recently, the use of more flexible barriers which are made from metal net and which are where applicable connected to ropes has become increasingly widespread. These systems, which are suitably installed on potentially unstable slopes, serve to intercept and block the fall of blocks of rock by means of a metal net which allows the impact forces to be transferred to the foundation structures by means of a complex system of cables and other connection elements. However, such structures are subjected to frequent maintenance and possible replacement of components which have become deformed following rockfalls, which generate a potential accumulation of irreversible plastic deformations in some portions of the structures. In addition, it is worth noting that, in the current state, testing of these structures is entrusted to impact tests at the real magnitude which are necessary to evaluate the real efficacy of each type of barrier. These tests are very difficult, in terms of both time and expenses.

In some situations involving danger from rockfalls, it is advantageous to install a rock-retaining covering or a surface-stabilizing net. These protection structures comprise nets which are fixed to the surfaces of the rocky inclines so that the rocks which become detached from the wall have the possibility of falling as far as the foot of the incline, whilst always remaining contained between the rock and the covering net. Examples of such protection structures are described in WO 2005/038143 and WO 2011/030316 from the same Applicant.

In other situations of danger from rockfalls, it is not advantageous to install a rock-retaining covering or a surface-stabilizing net as a result of technical problems, topographical problems, economic problems or problems of access. In these cases, an effective solution involves the installation of rock-retaining barriers along the rocky incline or at the bottom of the slope in accordance with the space available. These barriers are positioned in order to intercept and block the fall of rocks and stones, dissipating the energy which is transmitted during the impact by means of plastic deformations of some components of the structure.

The rock-retaining barriers are substantially characterized by an interception structure (the net), a support structure (uprights and bracing ropes) and a braking system which is constituted by sacrificial elements, the so-called brakes or dissipators which are intended to become extended, thereby greatly dissipating the energy being introduced. The energy dissipation systems currently in use are typically based on the plasticization of metals (aluminium, steel) or on the friction between contact surfaces. However, it is evident that, after the impact with a rock having energy which can be compared with the projected energy, a permanent deformation of the structure which limits the performance levels thereof is recorded because the structure cannot withstand additional deformations in the case of subsequent impacts until there is provision for replacing the deformed elements, taking up the initial geometric configuration again from before the impact.

The performance levels of the rock-retaining barriers are typically expressed in terms of interception energy of the barrier and height of interception, which is intended to be understood to be the minimum distance between the lower rope and upper rope of the barrier.

The standard ETAG 0271 defines two different performance levels for the certification of rock-retaining barriers. The first level, called MEL (Maximum Energy Level) provides for the barrier to be capable of intercepting and blocking a mass which impacts against the barrier with the maximum energy level thereof (100%), having a residual height >50% with respect to the initial height. The second performance level, called SEL (Service Energy Level) provides for the barrier or to be capable of intercepting and blocking two successive masses (without any maintenance) striking the barrier with an energy level equal to 30% of MEL. The residual height must in this case be >70% with respect to the initial height.

In light of a significant reduction of the residual height of the barrier, downstream of an event with a given magnitude it is necessary to carry out extraordinary maintenance operations which are intended to replace the brakes and any other damaged components, restoring the initial geometric configurations of the barrier. All this involves high administration costs, also taking into account that the rock-retaining barriers are generally installed on rocky inclines, in places which are often remote and accessible only with difficulty.

An example of a rock-retaining barrier is described in EP 0940503 from the same Applicant. There are also known barriers, for protection from falling debris in matrixes of mud and water or in rocky matrixes as a result of floods, which can be installed on gradients, both open gradients and within valleys and gorges, and which provide for the use of uprights or no uprights depending on the morphology. An example of such barriers is described in WO 2014/141096 from the same Applicant.

In these known types of protection structures, one of the greatest disadvantages is the need to completely or partially replace the protection structure after the structure has been involved in an impact of a significant magnitude. The replacement may completely or partially involve the metal net or the anchoring members thereof or, in the case of the barriers, the bracing ropes or support ropes of the net or the dissipation elements. These maintenance operations are expensive and often very difficult as a result of the position of the protection structures which are very often installed on steep inclines, inaccessible slopes or isolated zones which are difficult to access.

In the field, therefore, there is perceived the need for improved solutions with respect to the performance levels of the protection structures which reduce the need for and the frequency of replacement, repair or maintenance and which allow the efficient and prolonged use thereof even following one or more operations for protection of an impact event.

STATEMENT OF INVENTION

An object of the invention is to provide a protection structure and/or a metal protection net to be used in a protection structure, such as, for example, a rock-retaining barrier or control barrier for the debris flows, which overcome(s) the disadvantages of the prior art. Another object of the invention is to improve the performance levels of the protection structures, for example, the rock-retaining barriers. Another object is to provide a protection structure and/or a metal protection net which maintain(s) the individual characteristics of resistance even following significant and repeated impacts from materials such as rocks, debris, snow and the like. Another object of the invention is to improve the performance levels of the protection structures, for example, the rock-retaining barriers. Another object is to provide a protection structure and/or a metal protection net which maintain(s) the individual characteristics of resistance even following significant and repeated impacts from materials such as rocks, debris, snow and the like. Another object is to provide a protection structure, a protection net and/or a metal protection net which are economical and durable over time and which allow the maintenance costs to be reduced.

Within the objects indicated above, a specific objective is to provide a protection structure, for example, a rock-retaining barrier, in which the re-centring of the structure is ensured, that is to say, the return of the protection structure to the pre-existing condition, at the end of the collision or impact and once the load has been removed, apart from occurrences of plasticization which are concentrated in the net and limited to a few circumscribed zones. Another specific objective is to prevent the replacement of the dissipators or brakes in the rock-retaining barriers which are provided therewith and the repositioning of the structure after impacts with a high energy content which can be compared with the projected content.

These objects and other objects are achieved by a protection structure and/or by a protection net having the features indicated in the appended claims.

The invention is based on the principle of converting the kinetic energy of the rocks into deformation energy of a number of components of the protection structures and particularly of the protection nets or portions thereof and/or the support members or portions thereof, on the basis of so-called smart materials, such as shape memory alloys. Such materials are often referred to using the acronym SMA (Shape Memory Alloys) and are characterized by reversible elongations if the deformations occur within the deformation range in a resilient range typical of these metal alloys (for example, but in a non-limiting manner, approximately from 8 to 10%). During the innovative use developed by the Applicant, such materials are used in the protection structures so as to be subjected to resilient deformations, dissipating energy and limiting the force transmitted to the anchoring members. When the impact load is removed, the elements made from an alloy of the SMA type again take up the initial geometric configuration thereof, thereby at least partially eliminating the deformation achieved. Therefore, this innovative approach has substantial advantages. Initially, the recovery of the initial configuration of the protection structure at the end of the impact is ensured once the load acting has been removed without any replacement of deformed dissipating elements. Consequently, this involves a reduction of the maintenance costs during use.

The originality of the present invention is substantiated by the absence of studies and/or publications relating to the possibility of using the properties of SMA materials for improving the technology of the current protection structures, such as rock-retaining barriers and the like. Therefore, the invention is configured as a radical innovation with respect to the current prior art because it introduces highly innovative elements which are capable of solving the typical problems of existing standard solutions, in addition to ensuring the technical and economic advantages indicated above.

Such protection structures involved in the present invention may include, without being limiting, rock-retaining barriers, snow-retaining barriers, hybrid rock-retaining barriers, snow catchers or consolidating catchers, nets for cortical reinforcement, nets for protection from falls of debris and other structures of the type. Examples of structures and/or protection nets which can be modified so as to be included in the present invention or so as to incorporate elements of the present invention are described in WO 2005/038143, WO 2011/030316, WO 2018/146516, WO 2014/141096 and WO 2021/053592 which are incorporated herein by reference.

BRIEF DESCRIPTION OF THE DRAWINGS

Additional features and advantages will be appreciated from the following detailed description of a preferred embodiment with reference to the appended drawings which are given by way of non-limiting example and in which.

DETAILED DESCRIPTION

Figure 1:
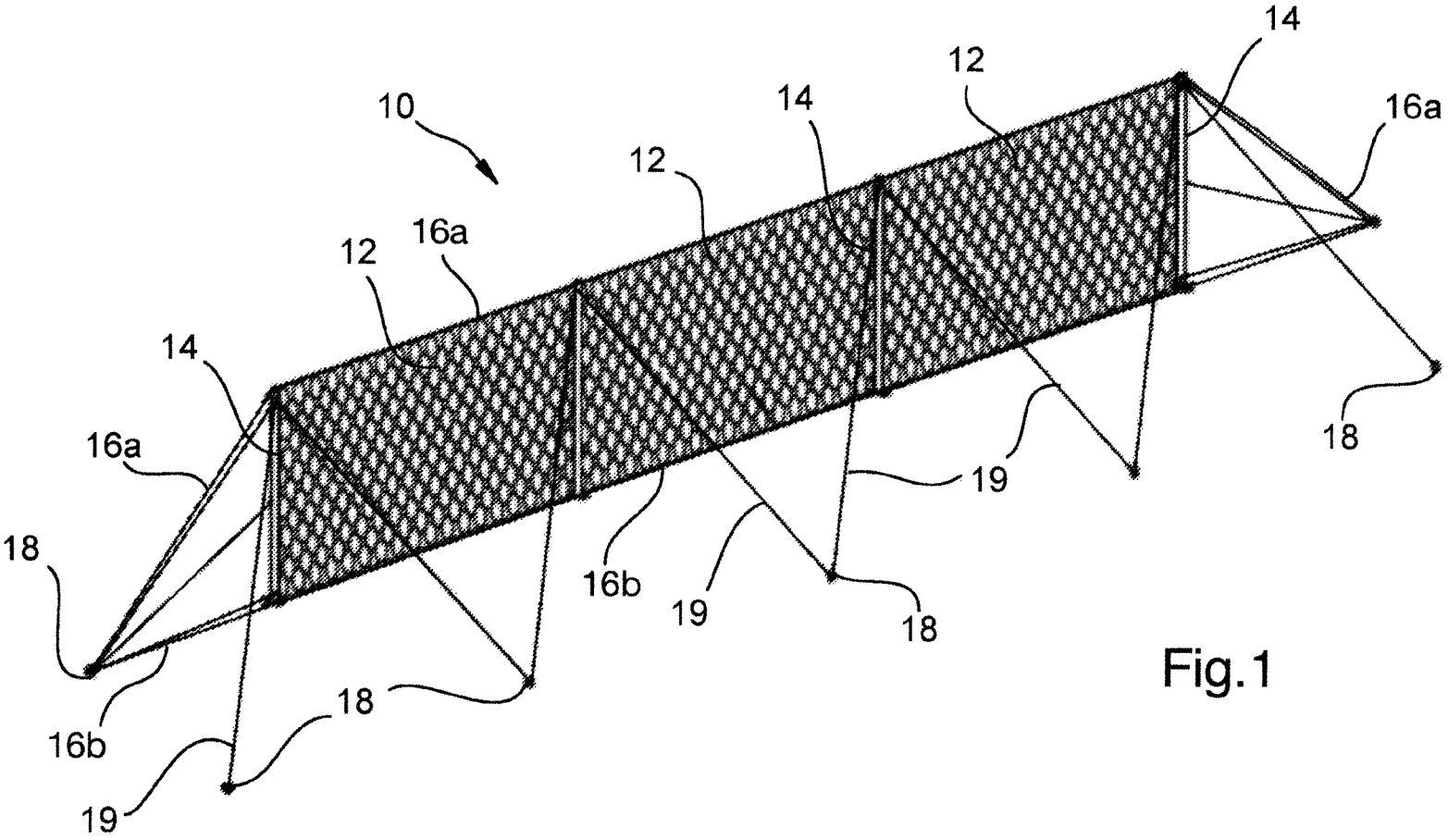
FIG. 1 is a perspective view of a protection structure in the form of a rock-retaining barrier incorporating aspects of the present invention.

Now with reference to FIG. 1, a protection barrier 10 against falling rocks, also called a rock-retaining barrier, comprises net panels 12 which are supported by uprights 14 which are fixed to the ground. A series of ropes 16*a* support the net 12 at the top in a continuous manner, preferably passing through the upper end of the uprights 14. One or more ropes 16*b* is/are connected in a longitudinally continuous manner to the lower end of the nets 12, preferably passing through the base of the uprights 14. The ropes 16*a* and 16*b* are fixed to anchoring members 18 which are fixed to the ground. The uprights 14 are also preferably connected by means of ropes 19 to other anchoring members 18 upstream of the barrier. In the embodiment illustrated, the protection barrier 10 does not have brakes or dissipators along the ropes 16*a*, 16*b* and 19. The net panels 12 are preferably constructed with a protection net of the type with rings or panels made from rope and with the possible addition of a metal net with double torsion or single torsion.

One or more components of the protection barrier 10, for example, all or some of the ropes 16*a*, 16*b* or 19, are made from materials which have a superelastic behaviour, the main characteristic of which involves the intrinsic capacity to be subjected to great resilient deformations, in the order of from 8 to 10%, resuming the initial configuration without any substantial residual deformations via the removal of the loading state, that is to say, by removing the rock which has impacted the work. More specifically, it is possible to use one or more metal alloys with superelastic behaviour, for example, but in a non-limiting manner, metal alloys of copper/zinc/aluminium Cu—Zn—Al, copper/aluminium/nickel Cu—Al—Ni, iron/manganese/silicon Fe—Mn—Si, titanium/nickel Ti—Ni, such as, for example, the alloy with 55.9% Ni and 44.1% Ti, commercially known as Nitinol, which have a good superelastic behaviour, that is to say, capacity to absorb greater resilient deformation energy, and a high hysteresis which produces a greater dissipation capacity. These alloys are further selected for their excellent resistance to fatigue and corrosion which makes them particularly suitable and efficient for applications with direct contact with the external environment and for the protection structures of the present invention.

The materials with superelastic behaviour as set out above are formed from wires, cables or ropes which are woven, interlaced or in any case connected to the protection nets of the protection structures. For example, it is possible to construct the ropes 16*a*, 16*b*, 19 completely or partially with ropes or wires or braking elements of an SMA material, such as Nitinol or the like; in this manner, after the removal of the impact load, the resilient elongation resulting from the impact of the block is recovered and the ropes return to the initial configuration before the impact, which is shown in FIG. 1.

Therefore, the barrier takes up the initial geometric configuration again, particularly the interception height, without any components being replaced. All this represents a substantial reduction of the maintenance costs, ensuring the maintenance of the safety level which the barrier is able to provide.

This restoration of the initial conditions can be limited to the energy which corresponds to the performance level which is denoted SEL (Service Energy Level) or can reach the level denoted MEL (Maximum Energy Level): the reaching of the two limits can be reached by means of the dimensions of the ropes 16*a* and/or 16*b* and/or 19 which are made from SMA alloys, or by also combining conventional dissipation elements with the ropes 16*a* and/or 16*b* and/or 19 made from SMA alloys.

Additionally or alternatively to the ropes made from SMA material, it is possible to interlace in the net panels 12 one or more rings which are made from wires of alloys of the SMA type. The protection structures can also be reinforced with bars or other elongate elements, which are superimposed on or interlaced with the protection nets, of an SMA material. For example, it is possible to construct a protection net with net panels which are constructed with one net of the double torsion type, with one or more resilient reinforcement elements which is/are interlaced with the net, inserted in the mesh thereof and/or incorporated in one or more of the double torsion nodes thereof which is made from an SMA material.

Figure 2:
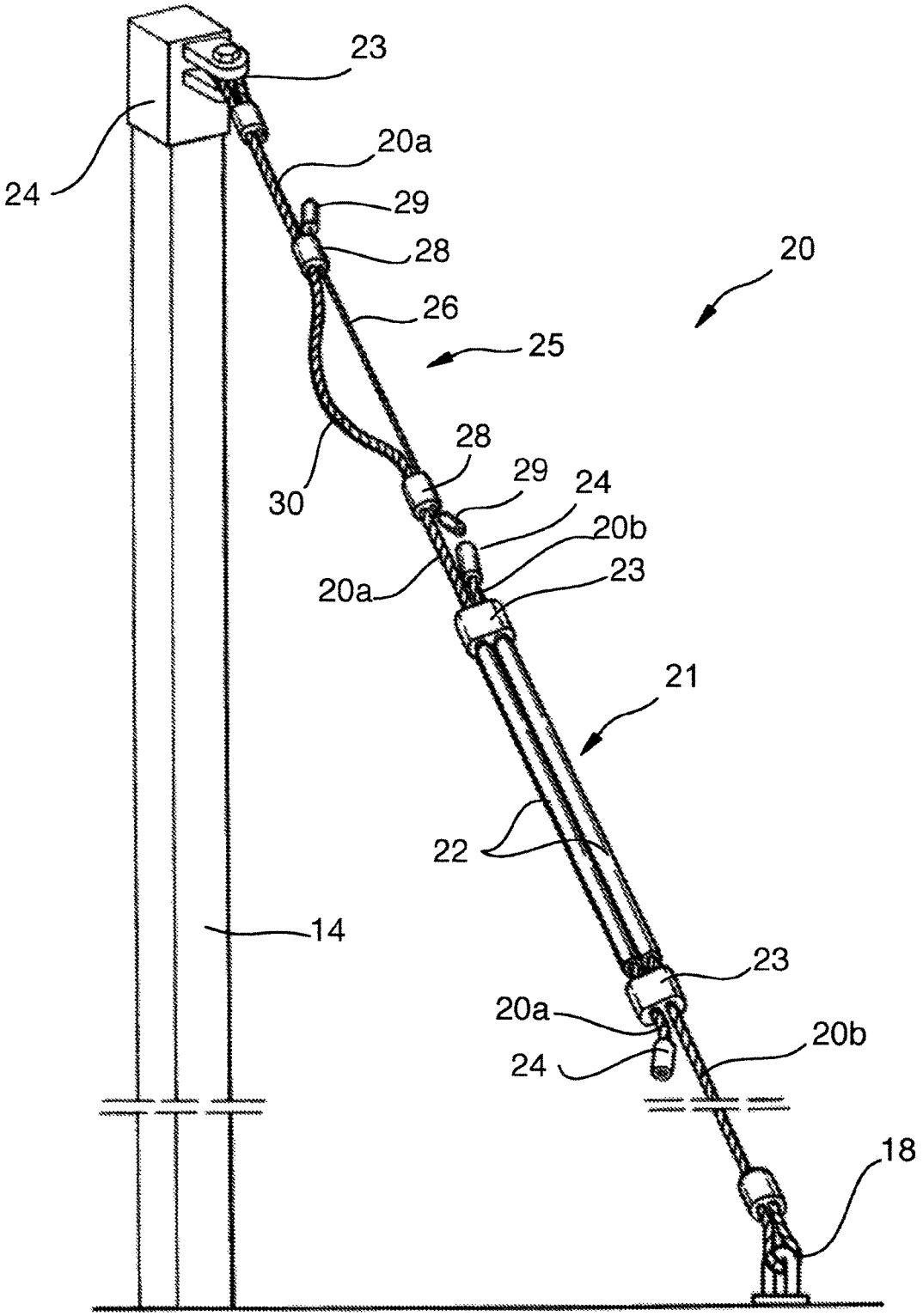
FIG. 2 is a perspective view of a different embodiment of a support rope for a protection structure similar to the structure of FIG. 1.

FIG. 2 illustrates a particular embodiment of a support rope 20 which is suitable for supporting a protection structure 10 which is similar to the one illustrated in FIG. 1 or more generally a protection structure comprising a net supported by uprights, such as, for example, a hybrid protection structure, in which a net is supported by uprights at the top thereof and is free in the lower portion.

In the example of FIG. 2, the rope 20 is formed by two rope portions 20*a*, 20*b* which are connected to each other in the region of a dissipator or brake 21 of the type generally known in the sector of the protection structures. As will become clearer below, the presence of the dissipator or brake 21 is not necessary for the purposes of the present invention to the extent that the rope 20 may also not be provided therewith, therefore being able to be constructed in a single piece. Furthermore, it is not necessary for the rope 20 to be made only from one or two pieces or from two pieces, but instead it can also be constructed by joining together several pieces, segments or portions of rope in series and/or in parallel. Preferably, the rope 20 is a metal rope made of steel.

The rope 20 is fixed to the ground by means of an anchoring member 18. At the other end, the rope structure 20 is fixed to the upper end 21 of an upright 14. The type of fixing of the rope 20 at the two ends thereof, to the ground and to the upright 14, respectively, may be of a type different from the one illustrated, in accordance with various techniques known in the field.

The dissipator or brake 21 if it is provided on the rope 20 is suitable for absorbing the impact energy, for example, of a landslip, which involves the protection structure. The dissipator or brake 21 illustrated comprises two metal tubes 22 which are beside each other and in which there extend the two respective rope portions 20*a*, 20*b*, the ends of which project at opposite sides of the dissipator or brake 21. Two compression heads 23 which are positioned at the ends of the metal tubes 22 are also passed through by the rope portions 20*a*, 20*b*, to the ends of which terminals 24 are fixed.

Traction on the rope portions 20*a*, 20*b* urges the terminal 24 against the compression heads 24, which in turn press on the tubes 22, causing the plastic deformation thereof if the traction is sufficiently great. The high impact energy on the protection structure is absorbed and dissipated during the deformation of the tubes 22.

There is also provided on the rope 20 a damping member 25 which resiliently responds to the traction stresses on the rope 20 up to a given magnitude as a result of impacts with less energy, in addition to which the dissipator or brake 21 can become operational. The damping member 25 comprises a resilient segment 26 which is interposed between two fixing locations 28 on the rope 20. The fixing locations 28 can be constructed by means of two metal sleeves which are crimped on the rope 20 or by connection means of the functionally similar type. The resilient segment 26 can be constructed with one or more rope portions, which are arranged in series and/or in parallel with respect to each other, of a material with superelastic behaviour, for example, of the type indicated above as Nitinol.

Figure 3:
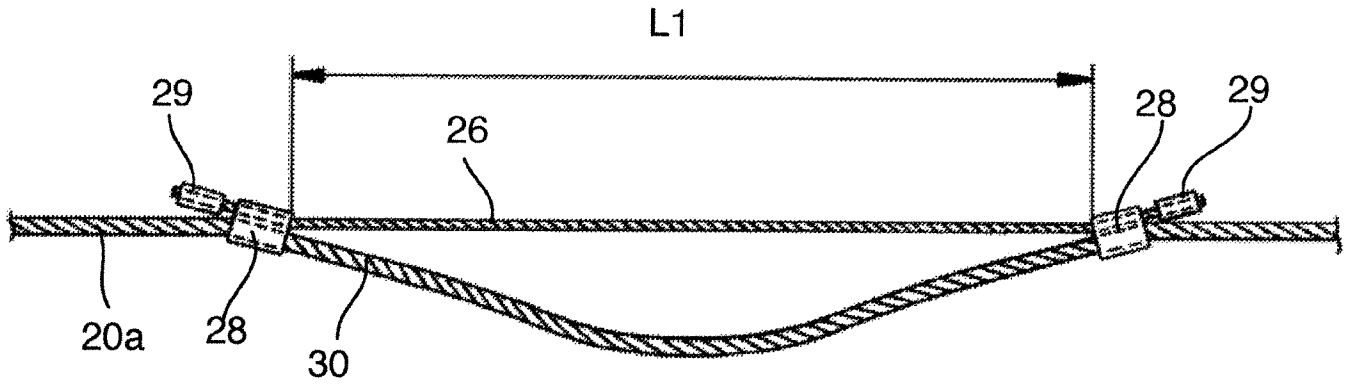
FIG. 3 illustrates a detail of the support rope of FIG. 2 in a configuration which is not subjected to loading, wherein a superelastic material element is in an unloaded and non-deformed condition.

As can also be seen in FIG. 3, in a non-deformed configuration thereof the resilient segment 26 has a length L1 between the two fixing locations 28 on the rope 20. The length L1 is established on the basis of the material of the resilient segment 26 and the characteristics of the protection structure. For example, the length L1 of the resilient segment 26 between the fixing locations 28 can be approximately 1 m even if it is not excluded that it may be less than or greater than 1 m. Two terminals 29 ensure that the resilient portion 26 does not fray or become detached from the fixing locations 28 when it is subjected to traction.

The rope 20 has, between the two fixing locations 28, a resistant portion 30 with a length L2 greater than the non-deformed length L1 of the resilient segment 26. Preferably, the length L2 is less than the length in addition to which the resilient segment 26 would be subjected to a permanent plastic deformation. Typically, the length L2 is approximately from 8% to 10% greater than L1, which means that for a resilient segment 26 with a length L1 equal to 1 m, the resistant portion 30 has a length L2 of approximately from 1.08 to 1.10 m.

Figure 4:
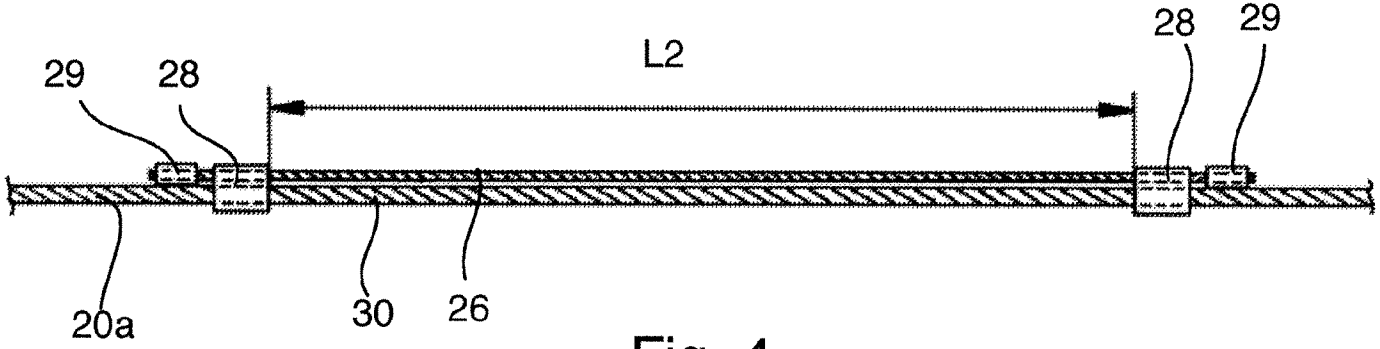
FIG. 4 illustrates the same detail of FIG. 3 in a configuration subjected to a load, wherein the superelastic material element is in a loaded condition with maximum deformation.

In the non-deformed configuration of the resilient segment 26, when the rope 20 is not subjected to any traction, the resistant portion 30 between the fixing locations 28 remains loose, as illustrated in FIGS. 2 and 3. FIG. 4 illustrates the limit case, in which the rope 20 is subjected to such a traction that the resilient segment 26 is subjected to the maximum predetermined elongation thereof, at which the deformation thereof remains within the superelastic range. When this limit is reached, the resistant portion 30 of rope becomes tensioned. If the traction on the rope 20 increases, the load is supported by the resistant portion 30, thereby preventing the resilient segment 26 from becoming plastically deformed. When the load on the rope 20 ends, the resilient segment 26 resiliently returns to the initial condition. If the traction has not been too high, the rope 20 returns to the pre-existing condition, ready for a new intervention without any need for replacing any component. If the traction on the rope 20 had to be very high, after the limit condition illustrated in FIG. 4 is reached, the dissipator or brake 21, if present, begins to operate, wherein the deformation of the metal tubes 22 acts as known in order to absorb the energy of the impact on the protection structure.

Although FIG. 2 illustrates one of the ropes 19 which support an upright 14, the formation of this rope provided with the damper 25 can also be replicated for one or more of the other support ropes of the protection structure, that is to say, of the ropes 16*a* which support the net 12 at the top in a continuous manner, or of the ropes 16*b* which are connected in a longitudinally continuous manner to the lower end of the net 12. Naturally, the principle of the invention remaining the same, the forms of embodiment and details of construction may be widely varied with respect to those described and illustrated without thereby departing from the scope of the present invention.

The invention claimed is:

1. A protection structure for civil works comprising:

at least one metal protection net comprising a plurality of elongate resistant elements in the form of wire, rope or cable;

wherein only some of the plurality of elongate resistant elements are made from a material having superelastic behaviour;

wherein at least one of the plurality of elongate resistant elements in the form of wire, rope or cable comprises a resilient segment which is made from the material having superelastic behaviour;

a resistant portion of the wire, rope or cable being initially arranged to be loose and beside the resilient segment, the resistant portion being tensioned while the resilient segment extends until an extension of the resilient segment is ended when a predetermined limit, which is less than a plastic deformation limit of the resilient segment, is reached; and wherein the resilient segment has a first length between two fixing locations and the resistant portion has a second length between the two fixing locations which is greater than a non-deformed length of the resilient segment.

2. The protection structure according to claim 1, wherein:

the elongate resistant elements having superelastic behaviour are portions of cables or ropes for anchoring the protection structure to the ground.

3. The protection structure according to claim 1, wherein:

the material having superelastic behaviour is selected from the group comprising metal alloys of copper/zinc/aluminium (Cu—Zn—Al), copper/aluminium/nickel (Cu—Al—Ni), iron/manganese/silicon (Fe—Mn—Si) and titanium/nickel (Ti—Ni).

4. The protection structure according to claim 3, wherein:

the material having superelastic behaviour is an alloy with 55.9% Ni and 44.1% Ti.

5. The protection structure according to claim 1, wherein:

the wire, rope or cable portion which limits the extension of the resilient segment which is made from the material having superelastic behaviour has the second length which is approximately from 8% to 10% greater than the non-deformed length of the material having superelastic behaviour.

* * * * *